US006125750A

United States Patent [19]

Achelpohl

[11] Patent Number: 6,125,750

[45] Date of Patent: Oct. 3, 2000

[54] DIGITAL ELECTROSTATIC PRINTING MACHINE

[75] Inventor: Fritz Achelpohl, Lienen, Germany

[73] Assignee: Windmöller & Hölscher, Lengerich/Westf., Germany

[21] Appl. No.: 09/320,211

[22] Filed: May 26, 1999

[30] Foreign Application Priority Data

May 26, 1998 [DE] Germany ..... 198 23 468

[51] Int. Cl.[7] ..... B41F 9/01; B41F 9/10

[52] U.S. Cl. ..... 101/153; 399/239; 399/249; 399/308; 101/154

[58] Field of Search ..... 399/131, 237, 399/239, 249, 308; 101/352.11, 352.13, DIG. 37, 153, 154

[56] References Cited

U.S. PATENT DOCUMENTS

| | | | |
|---|---|---|---|
| 4,024,838 | 5/1977 | Horie | 399/239 |
| 4,493,550 | 1/1985 | Takekida | 399/239 |
| 5,151,712 | 9/1992 | Arahara et al. | 101/DIG. 37 |
| 5,826,147 | 10/1998 | Liu et al. | 399/237 |
| 5,943,534 | 8/1999 | Watanabe | 399/239 |
| 5,943,535 | 8/1999 | Watanabe | 399/239 |
| 5,966,570 | 10/1999 | Till et al. | 399/237 |

*Primary Examiner*—Stephen R. Funk

*Attorney, Agent, or Firm*—Jacobson, Price, Holman & Stern, PLLC

[57] ABSTRACT

The invention relates to a digital electrostatic printing machine, comprising a cylinder with an electrostatically chargeable surface (PIP cylinder), to which charging electrodes, a laser write head and a quench electrode are assigned, and comprising an ink applicator, a transfer cylinder and a central cylinder. According to the invention, the ink applicator comprises an engraved roller.

6 Claims, 1 Drawing Sheet

DIGITAL ELECTROSTATIC PRINTING MACHINE

BACKGROUND

1. Field of the Invention

The invention relates to a digital electrostatic printing machine having an ink applicator, a transfer cylinder, a central cylinder, and an electrostatically chargeable surface to which charging electrodes, a laser write head and a quench electrode are assigned.

2. Description of the Related Art

In principle such digital electrostatic printing machines already exist. The central unit of such digital electrostatic printing machines is a cylinder with an electrostatically chargeable surface (PIP cylinder). On the periphery of the cylinder the cylinder is statically charged with charging electrodes in a first station. Then a digital original is recorded by means of suitable software on the surface as the positive electrostatic pattern. In the next station, ink is transferred, according to this positive image, from the ink applicator to the cylinder. Then the ink is transferred onto the transfer cylinder and between transfer cylinder and central cylinder printed on the material to be printed. Behind the transfer cylinder the surface of the electrostatically chargeable cylinder is cleaned, before it is recharged with the suitably allocated charging electrodes.

In the case of this prior art digital electrostatic printing machine, the ink, to be transferred from the ink applicator, has to be transferred onto the image, which has been applied as a positive by the laser write head, at a high speed. However, there is the risk at high printing speeds that the applied ink will be blurred.

SUMMARY OF THE INVENTION

Therefore, the object of the invention is to improve in such a manner a prior art digital electrostatic printing machine that it can be operated at high printing speeds without the risk of the image being blurred.

The present invention solves this problem with an electrostatic printing machine having an ink applicator, a transfer cylinder, a central cylinder, and an electrostatically chargeable surface to which charging electrodes, a laser write head and a quench electrode are assigned. The ink applicator comprises an engraved roller, onto which the ink can be applied by means of a doctor chamber. Thus the engraved roller is totally coated with ink. In contrast to the prior art, the ink is removed in accordance with the negative image from the engraved roller, totally coated with ink, by means of the cylinder with the electrostatically chargeable surface. In so doing, the negative image is transferred by way of the laser write head to the cylinder with the electrostatically chargeable surface. The positive image remains on the engraved roller and is transferred to the transfer cylinder, which is arranged next to the engraved roller. Then the ink is transferred by means of the transfer cylinder to the medium, which is to be printed and which passes between the central cylinder and the transfer cylinder.

In a preferred embodiment, an ink collecting roller is located next to the transfer cylinder to remove excess ink from the transfer cylinder. The ink collecting roller may also be arranged next to the cylinder with the electrostatically chargeable surface so that excess ink may be removed from the cylinder with the electrostatically chargeable surface. The ink collecting roller may further include a doctor blade with an ink catch chamber. The present invention may further be embodied to include a quench electrode assigned in the direction of rotation following the engraved roller to the cylinder with the electrostatically chargeable surface. In addition, a cleaning roller may rest in the direction of rotation of the cylinder with the electrostatically chargeable surface, before charging electrodes lying against the cylinder with the electrostatically chargeable surface.

BRIEF DESCRIPTION OF THE DRAWINGS

Details and advantages of the invention are explained with reference to one embodiment, depicted in the drawing.

DETAILED DESCRIPTION OF THE PREFERRED EMBODIMENTS

Figure 1:
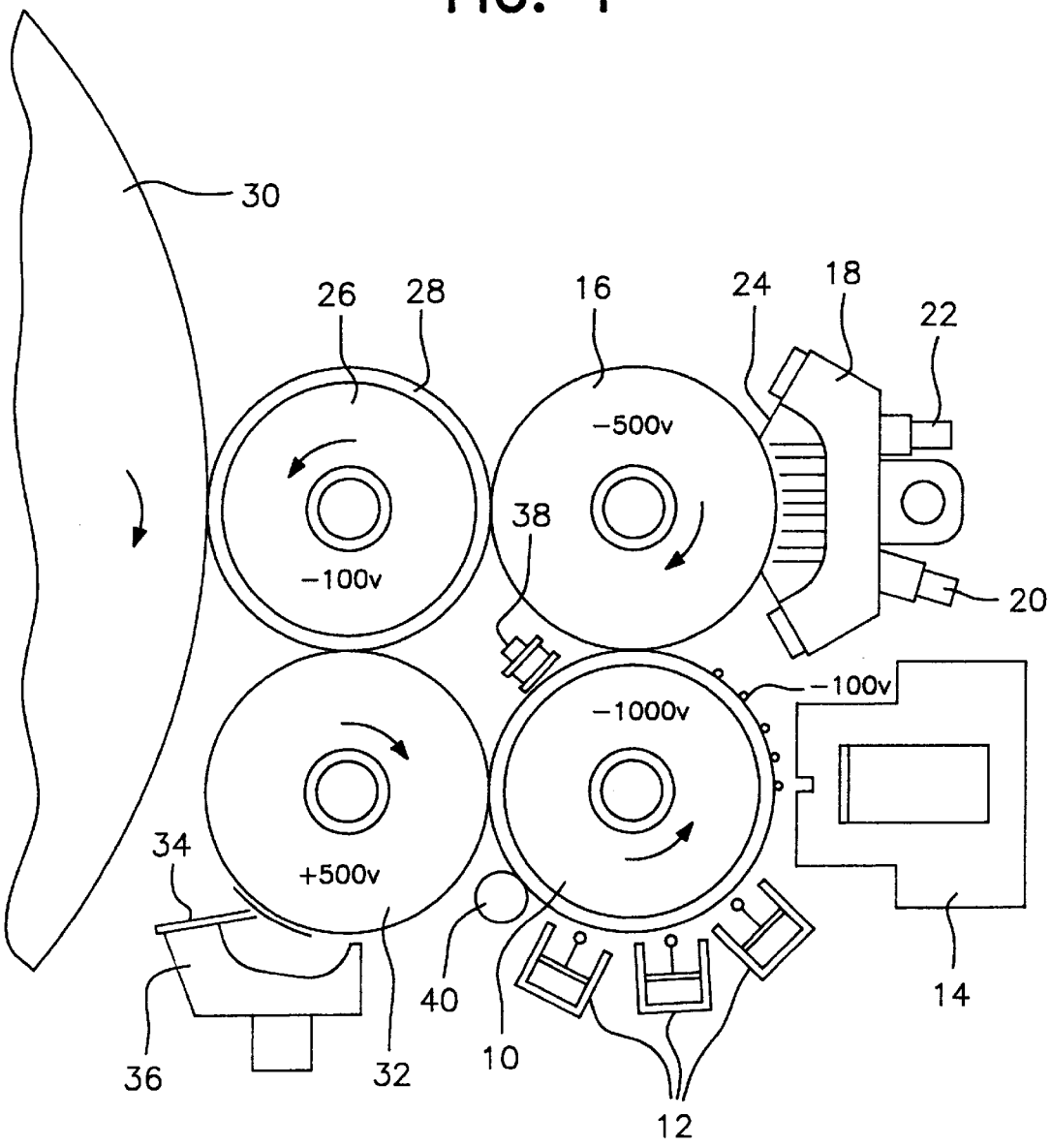
FIG. 1 is a schematic construction of a digital electrostatic printing machine, according to the present invention.

As shown in FIG. 1, a cylinder 10 with an electrostatically chargeable surface, a so called seamless PIP cylinder, rotates in the direction of the arrow and is charged to −1,000 volts by means of charging electrodes 12 on its surface. In the direction of rotation a laser write head 14 is attached to the charging electrodes 12; said laser write head 14 records via suitable software the negative image on the electrostatically chargeable surface. The surface, corresponding to the negative image, exhibits −100 volts. In the direction of rotation behind the laser write head 14 there is an engraved roller 16, which rotates in the direction of the arrow and touches the surface of the cylinder 10. Printing ink is applied by doctor via the doctor chamber 18 on the engraved roller 16.

The doctor chamber 18 exhibits an ink inflow 20 and an ink outflow 22. To apply by doctor the ink there are doctor blades 24.

The engraved roller 16 is set at −500 volts in the embodiment, illustrated here. According to this embodiment, the printing ink is transferred at the contact gap with cylinder 10 in the areas of the negative image, which is charged to −100 volts, to the cylinder surface of cylinder 10. Thus, all that remains is only the positive image, which in the areas which are charged to −1,000 volts on the cylinder 10, does not pass from the cylinder 10 to the engraved roller 16. This positive image transfers to the transfer cylinder 26, which is arranged next to the engraved roller 16 and which exhibits a gumming 28, since the transfer cylinder 26 is charged to −100 volts. The positive image, transferred here, is transferred to a print carrier (not illustrated in detail), which rotates between the central cylinder 30, which rotates in the direction of the arrow, and the transfer cylinder 26, which also rotates in the direction of the arrow. The residual printing ink is transferred from the transfer cylinder 26 to the ink collecting roller 32, which is arranged next to the transfer cylinder 26 and also rotates in the direction of the arrow, and is removed by doctor by means of a doctor blade 34 and is fed with return pipes to an ink catch chamber 36. The surface of the ink collecting roller 32 is set to +500 volts in the embodiment shown here. As shown in the Figure, the surface of the ink collecting roller 32 also makes contact with the surface of the cylinder 10, so that the printing ink, transferred thereto, can also be removed.

Between the engraved roller 16 and the ink collecting roller 32 the surface of the cylinder 10 still travels through suitable quench electrodes 38, which quench the charge on the surface of cylinder 10. Since the surface of the ink collecting roller 32 is set to +500 volts, the ink is completely transferred to the ink collecting roller 32 and is removed by doctor there with the doctor blade 34, as described above.

The ink collecting roller 32 can still be followed by a cleaning roller 40, as shown in FIG. 1.

What is claimed is:

1. A digital electrostatic printing machine, having a cylinder with an electrostatically chargeable surface (PIP cylinder), to which charging electrodes, a laser write head and a quench electrode are assigned, and including an ink applicator, a transfer cylinder and a central cylinder, the ink applicator comprising an engraved roller, onto which ink is applied by means of a doctor chamber, the ink being removed in the form of a negative image from the engraved roller by way of the cylinder with the electrostatically chargeable surface so that the ink remains on the engraved roller as the positive image, and the transfer cylinder being arranged next to the engraved roller so that the ink is transferred onto it.

2. The electrostatic print machine, as claimed in claim 1, further comprising an ink collecting roller next to the transfer cylinder to remove excess ink from the transfer cylinder.

3. The electrostatic print machine, as claimed in claim 2, wherein the ink collecting roller is arranged next to the cylinder with the electrostatically chargeable surface so that excess ink can be removed from the cylinder with the electrostatically chargeable surface.

4. The electrostatic print machine, as claimed in claim 2, further comprising a doctor blade with an ink catch chamber assigned to the ink collecting roller.

5. The electrostatic print machine, as claimed in claim 1, wherein the quench electrode is assigned in the direction of rotation following the engraved roller to the cylinder with the electrostatically chargeable surface.

6. The electrostatic print machine, as claimed in clam 1, further comprising a cleaning roller resting, with respect to a direction of rotation of the cylinder with the electrostatically chargeable surface, before the charging electrodes against the cylinder with the electrostatically chargeable surface.

* * * * *